US007849902B2

(12) United States Patent
Kühn

(10) Patent No.: US 7,849,902 B2
(45) Date of Patent: Dec. 14, 2010

(54) APPARATUS FOR MAKING A SPUNBOND WEB

(75) Inventor: Walter Kühn, Sankt Augustin (DE)

(73) Assignee: Reifenhauser GmbH & Co. KG Maschinenfabrik, Troisdorf (DE)

( * ) Notice: Subject to any disclaimer, the term of this patent is extended or adjusted under 35 U.S.C. 154(b) by 299 days.

(21) Appl. No.: 12/147,562

(22) Filed: Jun. 27, 2008

(65) Prior Publication Data

US 2009/0008036 A1 Jan. 8, 2009

(30) Foreign Application Priority Data

Jun. 29, 2007 (EP) ..... 07012794

(51) Int. Cl.
*B32B 5/26* (2006.01)

(52) U.S. Cl. ..... 156/441; 156/181; 198/835; 198/840; 198/842

(58) Field of Classification Search ..... 156/181, 156/441; 198/835, 840, 842
See application file for complete search history.

(56) References Cited

U.S. PATENT DOCUMENTS 4,592,463 A * 6/1986 Puskar ..... 198/842
5,213,202 A * 5/1993 Arnold ..... 198/835
6,385,825 B1 5/2002 Wang et al. ..... 28/107
6,784,125 B1 8/2004 Yamakawa et al. ..... 442/328
2004/0121673 A1 * 6/2004 Geus et al. ..... 442/26
2004/0214498 A1 10/2004 Webb et al. ..... 442/329

* cited by examiner

*Primary Examiner*—Jeff H Aftergut
*Assistant Examiner*—David Simmons
(74) *Attorney, Agent, or Firm*—Andrew Wilford

(57) ABSTRACT

An apparatus for making a spunbond web has a foraminous deposition belt, a system for depositing fibers on the belt such that some of the fibers engage through the belt, and an output roller over which the belt is spanned for normally advancing an upper stretch of the belt in a transport direction toward the output roller. The output roller has a radially outwardly directed outer surface engaging the belt and formed with a profiling in turn formed by high spots contacting the belt and low spots out of contact with the belt so that fibers engaged through the belt are only pinched between the belt and the output roller at the high spots. The web is pulled downstream off the belt at the output roller.

11 Claims, 3 Drawing Sheets

APPARATUS FOR MAKING A SPUNBOND WEB

FIELD OF THE INVENTION

The present invention relates to a spunbond web. More particularly this invention concerns an apparatus for making such a web, normally felted.

BACKGROUND OF THE INVENTION

A spunbond web is normally made by depositing fibers on a foraminous deposition belt. The fibers are often made of a thermoplastic synthetic resin. Generally and preferably, a suction device is provided under the foraminous deposition belt to draw air down through the foraminous deposition belt in the area where the fibers are deposited.

An apparatus of the type described above is known in practice in various embodiments. The foraminous deposition belt is usually guided over several rollers so that there is substantial contact between the roller surfaces and the deposition belt. Once the fibers are deposited on the foraminous deposition belt, some of them are sucked through the belt, e.g. between the warp and weft of the belt. These are termed "throughshots."

The known apparatus has in the transfer area where the web is separated from the belt an output roller over which the deposition belt passes through a relatively large angle. In this output area, the spunbond web is usually transferred from the deposition belt to a calender in which it is compacted, so that the web moves off in its horizontal plane while the underlying belt pulls downward away from it as it moves around the output roller. As a result of the separation of the spunbond web from the belt, with the throughshot filaments passing through both, the bridging fibers are torn off, and the torn-off fibers are freed to go into the air as fiber waste (so-called "snow"). The fibers remaining between the warp and weft threads of the belt are pressed into and onto the belt due to the interaction of the belt with the rollers of the apparatus, thus forming undesired adhesion points for the spunbond web on the belt. This contamination of the belt has an adverse effect on the quality of the spun non-woven materials produced.

OBJECTS OF THE INVENTION

It is therefore an object of the present invention to provide an improved apparatus for making a spunbond web.

Another object is the provision of such an improved apparatus for making a spunbond web that overcomes the above-given disadvantages, in particular by means of which particularly the undesired fiber waste, or "snow," and the undesired contamination of the belt can be prevented.

SUMMARY OF THE INVENTION

An apparatus for making a spunbond web has according to the invention a foraminous deposition belt, means for depositing fibers on the belt such that some of the fibers engage through the belt, and an output roller over which the belt is spanned for normally advancing an upper stretch of the belt in a transport direction toward the output roller. The output roller has a radially outwardly directed outer surface engaging the belt and formed with a profiling in turn formed by high spots contacting the belt and low spots out of contact with the belt so that fibers engaged through the belt are only pinched between the belt and the output roller at the high spots. The web is pulled downstream off the belt at the output roller.

The invention provides for the deposition of fibers/filaments made of thermoplastic synthetic resin onto the belt. According to one embodiment the fibers are continuous filaments. Preferably, the fibers/filaments are cooled and stretched, or aerodynamically stretched before they are deposited on the foraminous deposition belt. Advantageously, the fibers/filaments are guided through at least one diffuser before they are deposited on the foraminous belt.

Due to the shape of the roller surface according to the invention, high spots and low spots are present on the outer surface of the roller. The belt is in contact only with partial areas of this outer surface, namely with the high spots.

The belt is generally guided across multiple rollers, or drive rollers. According to a very preferred embodiment having particularly great meaning to the invention, the profiled roller according to the invention is the output roller for the spunbond web. In this context, an output roller means that the spunbond web that is moved across the output roller is transferred in a travel direction downstream of the output roller to a processing device for the spunbond web, or to a further conveyor device (conveyor belt, belt, or such). According to a very preferred embodiment of the invention the output-roller outer surface is also profiled, or equipped with the high spots and low spots. Advantageously, the output roller is also a drive roller for the drive of the foraminous deposition belt.

According to a particularly preferred embodiment of the invention the profiled roller, or the profiled output roller serves to transfer the spunbond web to a calender. Advantageously, the spunbond web subsequent to the movement across the output roller in the travel direction is therefore pulled by a calender, or between two calender rollers of a calender downstream from the output roller.

The invention provides that the belt is spanned over the roller, preferably the output roller, through an angle of at least 70°, preferably at least 90°, and most preferably at least 120°. According to a particularly preferred embodiment of the invention the belt is spanned over the output roller profiled according to the invention through an angle of 125° to 145°, for example, through an angle of 135°, or about 135°.

The invention further provides that at least 70%, preferably at least 80%, and particularly preferably at least 90% of the outer surface is profiled. This percentage of the surface area of the roller is therefore provided with the high spots and the low spots that alternate on the outer surface. According to one embodiment of the invention, the high spots and the low spots are uniformly distributed over the outer surface.

A particularly preferred embodiment of the invention is characterized in that the profile of the outer surface is embodied in the form of grooves and ridges extending angularly or circumferentially around the roller outer surface. The ridges thus form the high spots, and the grooves form the low spots. In this recommended embodiment of the invention linear contact zones are thus formed between the roller and the foraminous belt.

A preferred embodiment of the invention is characterized in that the position of the contact points between the belt and the roller continuously changes when the belt is in motion, or with rotation of the roller, as a result of the shape of the profiling. The invention also provides that the position of these contact regions changes discontinuously due to the profile of the roller. According to a preferred embodiment, the profile is shaped like at least one screwthread. In this case, the previously mentioned ridges (high spots) and grooves (low spots) are integral parts of a thread having a certain pitch. Due to the pitch of the thread, the contact points continuously move between the outer surface and the foraminous deposition belt in an advantageous manner.

According to a recommended embodiment, two screwthreads are provided on the roller, or on the profiled outer surface. Advantageously, each thread extends from the center of the roller (with regard to the longitudinal extension of the roller) to an end of the roller. Preferably, the first thread is a right-handed thread, and the second thread is a left-handed thread. The invention also provides that the ridges and grooves do not extend angularly around the entire circumference of the roller. This way, discontinuous embodiment of the grooves in the outer surface is also possible.

According to a recommended embodiment of the invention the depth t of the low spots, or the depth t of the grooves, respectively, is 0.05 to 1.0 mm, preferably 0.05 to 0.6 mm, and most preferably 0.1 to 0.3 mm. The low spots or grooves provided on a roller may also have different depths t, or the depth t of a low spot or a groove can change along the low spot, or along the groove, in particularly, they may change continuously.

A particularly preferred embodiment of the invention is characterized in that the profiled roller (macro-profile) also has a micro-profile on its surface. Preferably, the high spots of the profiled, or macro-profiled outer surfaces, also have a micro-profile on their surfaces. Advantageously, the surfaces making contact with the belt of the ridges extending angularly at least partially around the circumference of the roller are micro-profiled. Preferably, the outer surface, or the surfaces of the high spots are profiled such that only point contact is made with the belt. A reduction of the surface friction by up to 50% can be achieved with micro-profiling in an advantageous manner. Preferably, the micro-profiling is constituted as a globular surface topography. According to a recommended embodiment of the invention the micro-profiling of the outer surface, or of the high-spot regions is created by means of thermal spraying or galvanic coating. The invention provides that the micro-profile formations constituted by the high spots have surfaces that are outwardly convex. According to a preferred embodiment the surfaces of the micro-high spots are shaped as tiny partial spheres and/or ellipsoids.

With this shape of the roller, preferably of the output roller, according to the invention the disadvantages known from the previously discussed prior art can be effectively avoided. The invention is based on the discovery that a contact-area reduction, or contact minimization between the foraminous belt and the roller leads to the solution of the technical problem according to the invention. As explained above, a distinctly visible amount of the fibers is aspirated through the belt, or between the warp and weft of the belt once the fibers are deposited on the foraminous deposition belt. Many known apparatuses provide an output roller that moves the belt directly upstream from a calender through an angle of about 135°. At this point, the spunbond web is transferred to the calender, or to the calender rollers. The shot-through filaments are pinched between the output outer surface and the belt in the contact zone, and pulled opposite to the conveyor travel direction. The spunbond web in contrast is pulled by the calender rollers and fed in the travel direction. If it is not possible to pull the shot-through and pinched filaments out of the belt, the filaments tear off, and the above described fiber waste ("snow") is the result. The torn off fibers that are not removed as the "snow," and that therefore remain between the warp and weft of the belt, are pressed into the foraminous belt by the rollers of the machine so that they form adhesion points for the spunbond web on the belt. As described above, this contamination of the belt has an adverse effect on the quality of the spunbond web. The invention is now based on the knowledge that the effects described above, and the inherent disadvantages can be avoided, if the roller, preferably the output roller, is profiled according to the invention. Of significant importance is the profiling (macro-profiling) in the form of ridges and grooves extending across at least part of the circumference of the roller. A particularly preferred embodiment that has proven to be reliable in this regard is characterized in that the surfaces of the high spots (of the macro-profiling) are also micro-profiled. It should be noted that the embodiment of the roller/output roller according to the invention spunbond webs of significantly increased quality can be produced. It should also be emphasized that the measures according to the invention can be realized and relatively low expense and in a cost-effective manner. It is also not a problem to retrofit already existing systems with the rollers/output rollers according to the invention.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
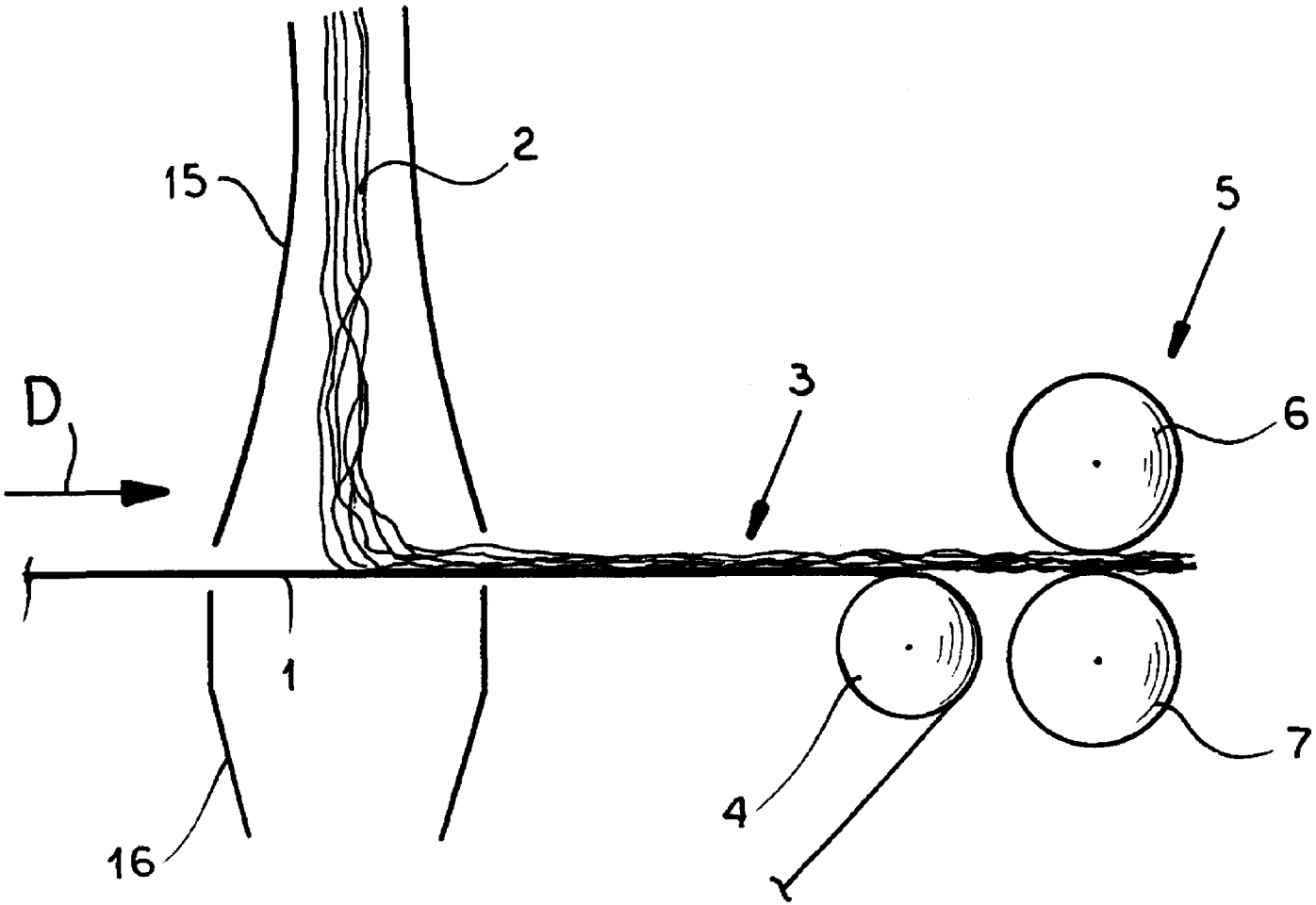
FIG. 1 is a schematic side view of an apparatus according to the invention for making a spunbond web.
Figure 2A:
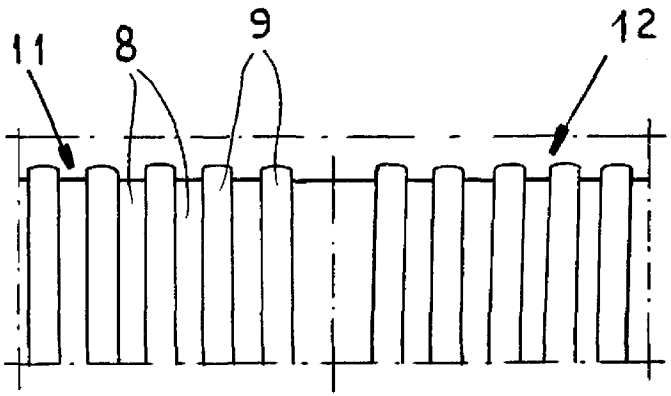
FIG. 2*a* is a large-scale view of a detail of the roller of FIG. 2.
Figure 2:
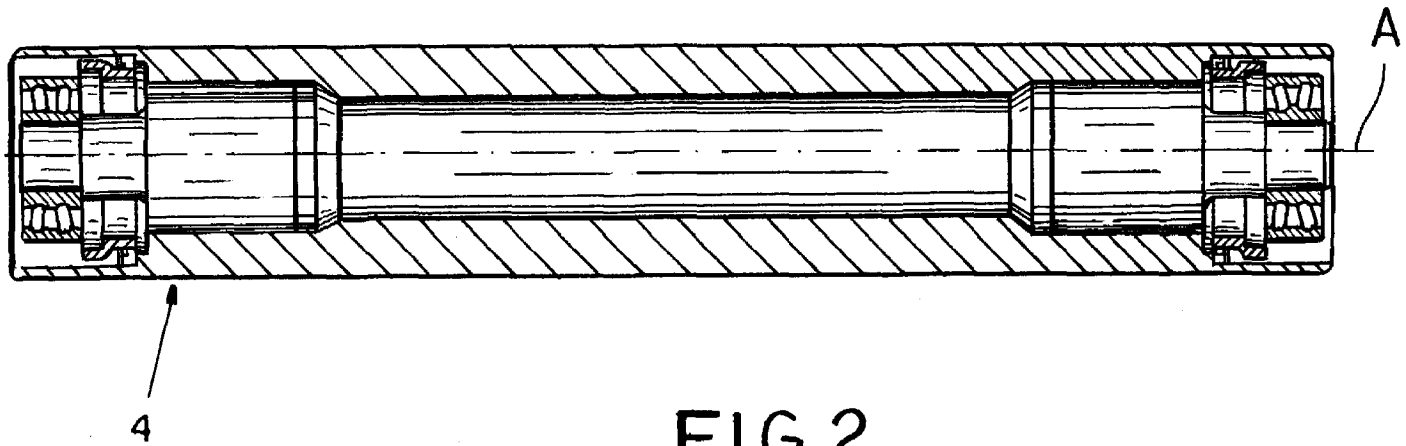
FIG. 2 is an axial section through the output roller according to the invention.

As seen in FIG. 1 an apparatus for the manufacture of spun non-woven material has a foraminous deposition belt 1 on which fibers 2 made of a thermoplastic synthetic resin can be deposited to make a spunbond web 3. The belt 1 is moved continuously so its illustrated horizontal upper stretch shifts in a horizontal travel direction D. The fibers 2 are preferably, and in the illustrated embodiment, continuous filaments. The belt 1 is spanned at the downstream end of its upper stretch over an output roller 4 through an angle of about 135° centered on an axis A of the roller 4. The spunbond web 3 is transferred there to a calender 5 in a travel direction downstream of the output roller 4, being pulled off the belt 1 by two pinch rollers 6 and 7 of the calender 5.

According to the invention the outer surface of the output roller 4 is formed with a profile (macro-profiling) that is made up of high spots and low spots. The belt 1 spanned over the output roller 4 is in contact only with the high spots of the outer surface. According to a particularly preferred embodiment the profile (macro-profiling) of the outer surface is constituted by grooves 8 (low spots) and ridges 9 (high spots) that in the illustrated embodiment preferably extend angularly around the circumference of the output roller 4. This results in only line contact between the belt 1 and the output roller 4.

Figure 3:
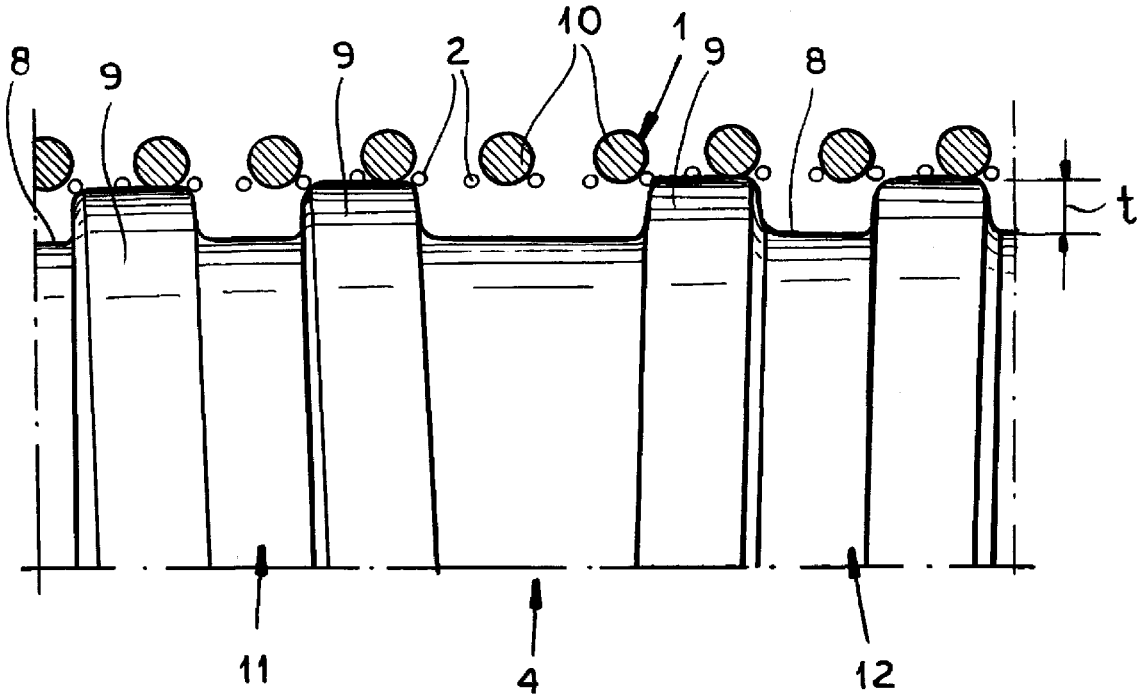
FIG. 3 is a large-scale section of the object of FIG. 2.
Figure 4:
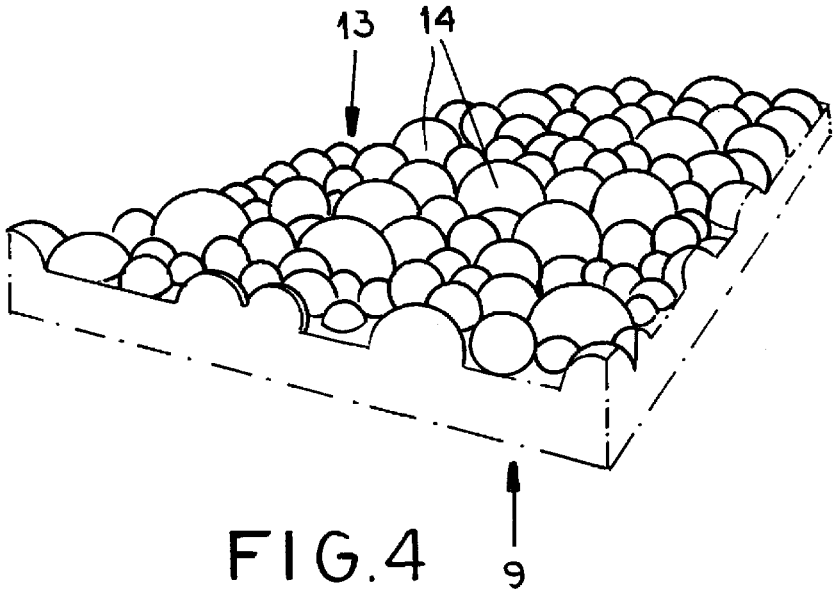
FIG. 4 is a perspective view of a microprofiled outer surface.

FIG. 3 shows the warp threads 10 of the belt 1 above the outer surface of the output roller 4 macro-profiled with grooves 8 and ridges 9 in an enlarged section. Fibers 2 suctioned through the belt 1, or shot through, can be seen below the warp threads 10. Due to the macro-profiling of the outer surface with grooves 8 and ridges 9, only some of the shot-through filaments 2 are pinched between the belt 1 and the output roller 4, namely only in the area of the ridges 9. FIG. 3 also shows that the diameter of the filaments 2 is substantially smaller than the diameter of the warp threads 10 of the belt 1.

Preferably, and according to the illustrated embodiment, the profiling (macro-profiling) of the output roller 4 is constituted as two screwthreads 11 and 12 of like pitch, each extending from the center of the output roller 4 to a respective outer end of the output roller 4. Advantageously and according to the illustrated embodiment, the screwthreads 11 and 12 are of opposite hand. In the illustrated embodiment the screwthread 11 is a left-handed screwthread, and the screwthread 12 is a right-handed screwthread. Due to the screwthread formation or due to the pitch of the profiling, the shot-through filaments 2 are clamped between the belt 1 and the ridges 9 only in two regions. At this point the contact between the belt 1 and the output roller 4 continuously changes with movement of the belt 1, or with rotation of the output roller 4. Once the shot-through filaments 2 are no longer pinched, they can be further conveyed along with the remaining spunbond web 3 due to the tension of the calender rollers 6 and 7. In this manner a tearing of the shot-through filaments 2, and therefore the disadvantageous "snow" can be avoided very effectively.

According to a very preferred embodiment of the invention the surfaces of the high spots of the profiling (macro-profiling) are also equipped with a micro-profiling 13. In the illustrated embodiment the outer surfaces of the ridges 9 have such a micro-profiling. Advantageously, and according to the illustrated embodiment, only point contact is formed between the belt 1 and the output roller 4, or the ridges 9 by means of the surface structure constituted by the micro-profiling. Preferably, and according to the illustrated embodiment, the micro-profiling corresponds to a globular surface topography. The surfaces of the microscopic spots 14 are advantageously formed as tiny spheres and/or ellipsoids. The micro-profiling of the ridge surfaces can be created, for example, by means of thermal spraying or galvanic coating.

I claim:

1. An apparatus for making a spunbond web, the apparatus comprising:

a foraminous deposition belt;

means for depositing fibers on the belt such that some of the fibers engage through the belt;

means including a roller over which the belt is spanned for normally advancing an upper stretch of the belt in a transport direction, the roller having an outer surface engaging the belt and formed with a profiling in turn formed by high spots contacting the belt and low spots out of contact with the belt, the high spots being formed with a microprofiling forming much smaller high spots, whereby fibers engaged through the belt are only pinched between the belt and the roller at the high spots;

means for pulling the web downstream off the belt.

2. The spunbond-making apparatus defined in claim 1, further comprising means underneath the upper stretch upstream of the output roller for sucking air and fibers through the upper stretch.

3. The spunbond-making apparatus defined in claim 1 wherein the means for pulling is a pair of calender rollers that grip the web downstream of the roller.

4. The spunbond-making apparatus defined in claim 1 wherein the roller is an output roller at a downstream end of the upper stretch and the belt is spanned over the output roller through an angle of at least 70°.

5. The spunbond-making apparatus defined in claim 1 wherein the roller is centered on an axis and the outer surface is radially outwardly directed, at least 70% of the outer surface being provided with the profiling.

6. The spunbond-making apparatus defined in claim 5 wherein at least 80% of the outer surface is provided with the profiling.

7. The spunbond-making apparatus defined in claim 1 wherein the profiling is formed by alternating grooves and ridges extending angularly relative to a center axis of the roller.

8. The spunbond-making apparatus defined in claim 1 wherein the grooves and ridges are formed by at least one screwthread.

9. The spunbond-making apparatus defined in claim 8 wherein the screw thread has a pitch such that the grooves and ridges extend generally helically.

10. The spunbond-making apparatus defined in claim 8 wherein there are two such screwthreads of opposite hand each extending axially over a respective portion of the outer surface.

11. The spunbond-making apparatus defined in claim 1 wherein the microprofiling is formed by thermal spraying or by galvanic coating.

* * * * *